United States Patent [19]

Bezhanov et al.

[11] 4,253,810

[45] Mar. 3, 1981

[54] CONCRETE PLACING APPARATUS FOR CASTING SOLID WALLS

[76] Inventors: Tigran V. Bezhanov, ulitsa Galaktiona Tabidze, 3/5, kv. 4; Edisher G. Rcheulishvili, ulitsa Titsiana Tabidze, 39, both of Tbilisi; Vladimir A. Bezhanov, ulitsa Papanina, 56, kv. 37, Baku; Anatoly T. Kvekveskiri, 1 Bzybsky proezd, 28, Sukhumi, all of U.S.S.R.

[21] Appl. No.: 113,494

[22] Filed: Jan. 21, 1980

[51] Int. Cl.[3] ..... E04G 11/22; B28B 21/16

[52] U.S. Cl. ..... 425/64; 249/20; 425/432; 425/65

[58] Field of Search ..... 425/62, 63, 64, 65, 425/60; 249/10, 11, 12, 13, 14, 15, 16, 17, 18, 19, 20, 21, 22

[56] References Cited

U.S. PATENT DOCUMENTS

| | | | |
|---|---|---|---|
| 735,214 | 8/1903 | Cramer | 425/65 |
| 1,122,982 | 12/1914 | Mumford | 425/63 |
| 2,607,100 | 8/1952 | Urschel | 425/60 |
| 2,723,437 | 11/1955 | Ghormley et al. | 425/65 X |
| 3,399,438 | 9/1968 | Rohlf | 249/17 X |
| 3,497,579 | 2/1970 | Barron | 425/63 X |
| 3,509,606 | 5/1970 | Fisher | 425/63 |
| 3,510,098 | 5/1970 | Fox | 425/63 X |
| 3,521,336 | 7/1970 | Rohlf | 425/63 |
| 3,600,773 | 8/1971 | Davis | 425/63 |
| 3,973,885 | 8/1976 | Schmidt | 425/65 |

FOREIGN PATENT DOCUMENTS

| | | | |
|---|---|---|---|
| 1377554 | 12/1974 | United Kingdom | 249/20 |

*Primary Examiner*—J. Howard Flint, Jr.
*Attorney, Agent, or Firm*—McAulay, Fields, Fisher, Goldstein & Nissen

[57] ABSTRACT

A concrete placing apparatus comprises jacks arranged in line along a wall to be erected, and U-shaped frames mounted on these jacks and connected with each other by scaffolds positioned along and on both sides of the line of arrangement of the jacks. The apparatus also includes driving carriages disposed on the scaffolds for movement therealong. Each carriage carries a feed hopper, a moulding board, and a concrete compacting means. According to the invention at least one of the moulding boards is provided with a drive for moving it in the direction transverse to the line of arrangement of the jacks. This drive is connected with the moulding board by means of a rod. The concrete compacting means is constructed in the form of a vibrating chute positioned under the feed hopper and above the moulding board and provided with a vibrating means for oscillating this chute along the direction of movement of the moulding board. The vibrating chute is mounted on the same carriage with the moulding board having a drive and consists of two parts attached to each other for extending in the direction of movement of this moulding board, so as to enable varying the passage area of the vibrating chute according to the change in the distance between a respective moulding board and the line of arrangement of jacks.

11 Claims, 9 Drawing Figures

CONCRETE PLACING APPARATUS FOR CASTING SOLID WALLS

BACKGROUND OF THE INVENTION

1. Field of the Invention

The present invention relates to construction machinery, and particularly to a concrete placing apparatus. The invention is applicable in the building industry for casting solid concrete and reinforced concrete walls.

2. Description of the Prior Art

There is known a variety of formworks which are used for casting solid walls. The USSR Author's Certificate No. N 224032 (Int. Cl E04G 11/12) describes a collapsible formwork which comprises jacks, formwork boarding mounted on both sides of the wall being cast, and U-shaped frames suspended on the jacks and provided with rollers to move on the formwork boarding.

Erecting a wall with the aid of such formwork is effected as follows. The concrete mix is poured into the formwork, and lifting the frames with the working deck as the wall grows in height, the lower part of formwork boarding is dismantled and mounted over the upper end of the formwork.

However, using the above collapsible formwork necessitates alternate dismantling and mounting the formwork boording during the whole operation, which entails increased consumption of labour and time.

Higher efficiency can be achieved with the aid of a sliding formwork (cf. "Opalubka," Politechnicheskiy Slovar, Moskwa, "Sowetskaya Encyclopedia," 1978, p. 328). The formwork of this type generally comprises the same elements as the formwork described above.

The U-shaped frames in this sliding formwork are not provided with rollers, and the formwork boarding is rigidly attached to the frames. In this case the formwork is lifted together with the frames, thereby providing for continuous casting of the wall. This type of formwork also has a number of disadvantages. First, this formwork is mounted along the whole length of the wall being erected and in the case of large walls, is large and heavy, thus complicating the whole concrete placing operation. It should also be noted that with the increase of length of the formwork boarding the amount of friction between the latter and the concrete also increases. Second, the above formwork, does not permit casting a wall with variable cross-section, and in particular is not adapted for producing offsets on the walls for the floor slabs or relieving slabs in the case of retaining walls to rest on. Third, this formwork doesn't permit erecting a wall using two different concrete compositions simultaneously, for example, a wall wherein the face side is made from the high-grade concrete and the back side from the low-grade concrete, or from light-weight and heavy-weight concretes respectively. This formwork does not permit, for the same reason, casting a wall with the face and back sides having different colours. Due to all these reasons the above formwork cannot provide savings either in labour or in materials.

For erecting solid concrete walls there are also used concrete placing apparatus, which provide for speeding up the erection operation. The USSR Author's Certificate No. N 654,786 describes a concrete placing apparatus for casting solid walls, permitting most of the difficulties associated with the above formworks to be overcome.

This concrete placing apparatus comprises jacks arranged in line along the wall being cast, U-shaped frames mounted on these jacks and connected with each other by means of scaffolds positioned along and on both sides of the line of arrangement of the jacks, and driving carriages mounted on these scaffolds for movement therealong, and carrying each a feed hopper, a moulding board and a concrete compacting means.

The concrete compacting means is a surface vibrator disposed behind the feed hopper and adapted for compacting freshly placed concrete.

The presence of carriages in this apparatus makes unnecessary using long moulding boards in the case of long walls, thus decreasing the size and weight of the apparatus.

Furthermore, owing to the presence of several feed hoopers mounted on the carriages positioned on both sides of the wall, the latter can be cast using two different concrete mixes simultaneously.

This concrete placing apparatus, however, also has a number of disadvantages. For example, it does not permit casing a wall with a variable cross section. In addition, the surface-type vibrators, which compact the concrete mix by impacting it after it has been placed, excite vibration of the previously placed concrete, thus preventing the latter from rapid setting, and thereby slowing down the operation.

SUMMARY OF THE INVENTION

The principal object of the present invention is to provide a concrete placing apparatus which would enable casting walls of a variable cross-section.

Another object of the invention is the provision of a concrete placing apparatus which, when compacting concrete being placed, would not exite vibrations of the previously formed concrete layers.

Yet another object of the present invention is the provision of a concrete placing apparatus which would permit the time required for the wall casting operation to be reduced.

Still another object of the present invention is to provide a concrete placing apparatus which would permit casting solid walls with inclined portions on one or both sides thereof.

An additional object of the invention is the provision of a concrete placing apparatus which would enable casting offsets on the walls being erected for the floor slabs or relieving slabs (in the case of retaining walls) to rest thereon.

A further object of the present invention is to provide a concrete placing apparatus ensuring a reduced friction between moulding boards and the concrete being cast, thereby reducing tractive effort for moving a concrete placing apparatus during operation, and a rate of wear of the moulding boards.

Still further object of the invention is the provision of such a concrete placing apparatus, wherein the moulding boards would produce the desired finish pattern on the wall being erected.

Yet further object of the present invention is the provision of a concrete placing apparatus which is simple both in manufacture and operation.

These and another objects of the invention are attained in that in a concrete placing apparatus for casting solid walls, comprising jacks, arranged in line along the wall being cast and carrying U-shaped frames connected with each other through scaffolds positioned along and on both sides of the line of arrangement of jacks, and driving carriages mounted on these scaffolds for movement therealong and carrying each a feed hopper, a moulding board and a concrete compacting means, according to the invention, at least one of the moulding boards is provided with a drive connected thereto by means of a rod and adapted for moving the latter in the direction transverse to the line of arrangement of jacks for varying the distance between the moulding boards, and the concrete compacting means of each of the carriages is made in the form of a vibrating chute disposed under the feed hopper and above the moulding board and having a vibrating means for oscillating along the direction of movement of the moulding board, the vibrating chute being disposed on the same carriage with the moulding board having a drive, and consisting of two parts connected to each other so as to be capable of extending along the direction of movement of this moulding board, one of these parts being connected with the drive thereof for varying the passage area of the vibrating chute according to the change in the distance between the moulding board and the line of arrangement of the jacks.

Such a construction of a concrete placing apparatus permits continuous compaction of the concrete mix with the aid of vibrating chutes before the mix is placed thus without causing vibration of the previously formed concrete layers, the passage area of the vibrating chutes and the distance between the moulding boards being varied simultaneously, thereby providing a control of the amount of the concrete mix being placed.

It is advisable that the moulding board be pivotally connected at its lower end to a rod of the drive and has a strut pivotally connected with its upper end and also provided with a locking means for being fixed on the rod at the desired distance from the lower end of the moulding board, which permits varying the angular position thereof relative to a vertical line and fixing it in the desired position.

Such construction of a concrete placing apparatus permits casting walls with inclined portions thereof on one or both sides and, in particular, producing offsets on the walls for the floor slabs, or relieving slabs (in the case of retaining walls) to rest on.

It is expedient that in the concrete placing apparatus according to the invention at least one moulding board be provided with a vibrating means to impart oscillating movement thereto along the line of movement of the carriages.

Such construction of the apparatus permits the friction between the moulding boards and the concrete to be reduced, thereby reducing rate of wear of the moulding boards and also tractive efforts for the movement of the concrete placing apparatus in the course of operation.

It is advantageous that in a concrete placing apparatus at least one of the vibrating chutes be provided with a projection extending below the upper edge of the moulding board and adapted for producing grooves in the wall as the latter is erected, which grooves being intended for providing a tie between the adjoining concrete layers, thus ensuring a higher strength of the wall being erected, which is especially appreciated in the case of using low-grade concretes.

It is advisable that the concrete placing apparatus have at least one of the moulding boards having a profile corresponding to the desired finish pattern so as to produce this pattern on the wall as the carriages are moved.

The possibility of producing finish pattern on the wall during the casting thereof permits casting concrete and finishing to be combined, thereby providing economy in both labour and time.

BRIEF DESCRIPTION OF THE DRAWINGS

The invention will now be described with reference to embodiments thereof in conjunction with the accompanying drawings, wherein.

DETAILED DESCRIPTION OF THE INVENTION

Figure 1:
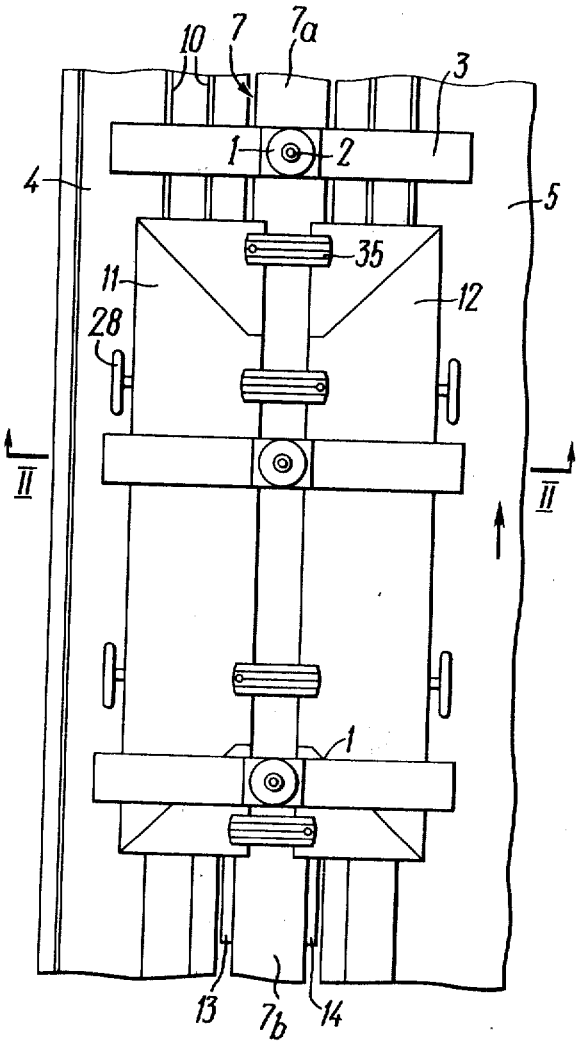
FIG. 1 schematically represents the concrete placing apparatus according to the invention, top view (shown by an arrow is the direction of movement of the apparatus during concrete placing operation)

A concrete placing apparatus for casting solid concrete walls comprises jacks 1 (FIG. 1), in particular hydraulic jacks mounted on jack rods 2 and arranged in line along a center line of a wall to be erected, and U-shaped frames 3 mounted on these jacks. Reinforcement bars of the wall being erected can be used as the jack rods 2.

The U-shaped frames 3 (FIG. 2) are connected with each other by scaffolds 4 and 5 disposed on both sides in the drawings on the left and along the line of arrangement of the jacks 1, and are provided with rollers 6 for moving up and along the wall 7 being erected.

The concrete placing apparatus also includes driving carriages 8 and 9 mounted in opposed relationship on rails 10 laid on and along the scaffolds 4 and 5.

On each of the carriages 8 and 9 there are mounted a feed hopper 11 or 12, a moulding board 13 or 14, and a concrete compacting means.

According to the invention the concrete compacting means is made in the form of a vibrating chute 15 or 16 disposed under the feed hopper 11 or 12 respectively and above the moulding board 13 or 14. The vibrating chutes 15 or 16 are provided with vibrating means 17 and 18 respectively, for imparting oscillatory movement thereto along the direction tronsverse to the line of arrangement of jacks 1, as shown by arrows in FIG. 2.

Figure 2:
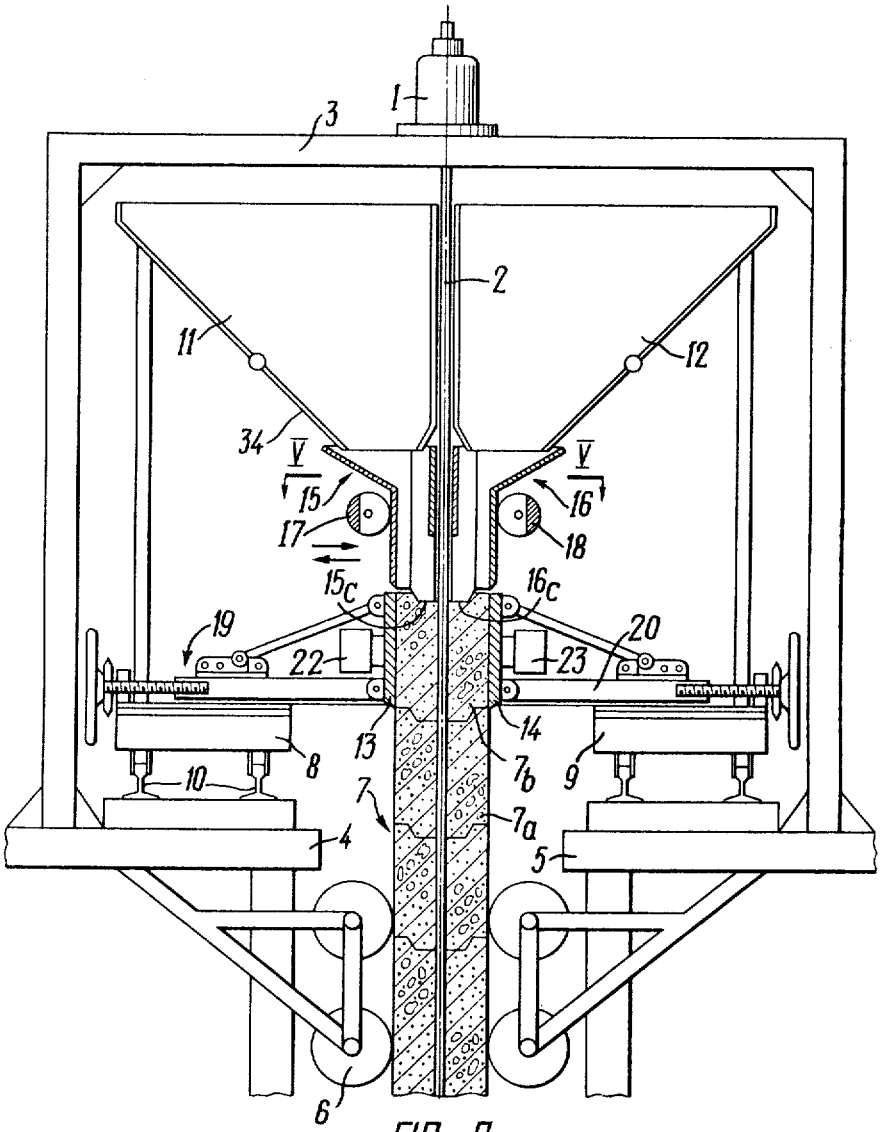
FIG. 2 is a cross section of the concrete placing apparatus, taken along line II–II in FIG. 1 (arrows show the direction of oscillation of the vibrating chutes)

For varying the distance between the moulding boards 13 and 14 to thereby control wall thickness, one of these moulding boards or each of them, as shown in FIG. 2, is provided with a drive 19 moving this moulding board transversely relative to the line of arrangement of the jacks 1. The moulding board is connected with the drive through a rod 20 mounted in guides 21 on the carriage 8 or 9.

To decrease friction between the concrete mix and the moulding boards 13 and 14, the latter are provided each with vibrating means 22 and 23 respectively, mounted thereon so as to impart oscillator motion thereto along the direction of movement of the carriages 8 and 9. Such construction decreases both the rate of wear of the moulding boards and a tractive effort for moving the concrete placing apparatus during operation thereof.

The drive 19 (FIG. 3) is constructed as a screw pair comprising a driving screw 24 installed in a bearing 25 for movement about its axis, and a nut 26 screwed thereon and connected to the rod 20.

To prevent the carriages 8 and 9 from being vibrated by the vibrating means 22 and 23 of the moulding boards 13 and 14, the guides 21 and the bearing 25 are fixed on the carriages through a shock-absorbing pad 27.

Rotation of the driving screw 24 for moving the moulding board 13 or 14 is effected in a conventional manner. The simplest way of rotating this screw (shown in the drawings) consist in that the latter is provided with a hand-operated wheel. The moulding board may be moved otherwise, for instance, with the aid of a power cylinder, such as a hydraulic cylinder (not shown).

For angular adjustment of the moulding board 13 (14) and fixing it at the desired angle relative to a vertical line, it is pivotally connected at its lower end to the rod 20, and is provided with a strut 29 pivotally connected to its upper end. The strut 29 has a fixing means for being fixed on the rod 20 at the desired distance from the lower end of the moulding board 13.

Figure 3:
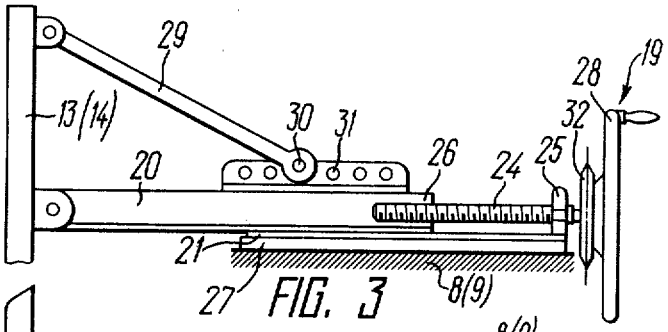
FIG. 3 shows a drive of the moulding board of the concrete placing apparatus, front view.

The above fixing means is a stop pin passed through an aperture provided in the strut 29 and introduced into one of apertures in a lug 31 fixed on the rod 20 (FIG. 3). The number of the apertures in the lug 31, the position of the latter and the distance between the apertures are selected depending on the predetermined angular position of the moulding board 13 (14). It is apparent that the fixing means may be otherwise embodied.

Figure 4:
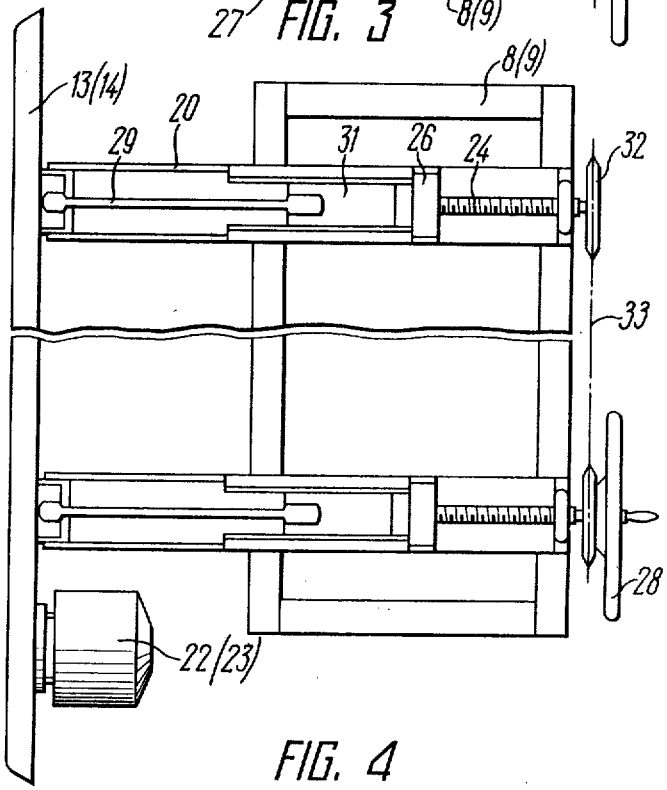
FIG. 4 shows the same as in FIG. 3, top view.

In the case of using relatively long moulding boards 13 and 14 it is advisable to provide each of them with two rods 20 connected to the ends thereof, with the number of the screw pairs and struts 29 being correspondingly increased (FIG. 4). In this case actuating the screw pairs may be effected by two hand-operated wheels 28, one for each screw pair as shown in FIG. 1, or by a common one, in which case (FIG. 4) the both screw pairs are movably connected with each other by means of two star wheels 32 and a chain 33.

Figure 5:
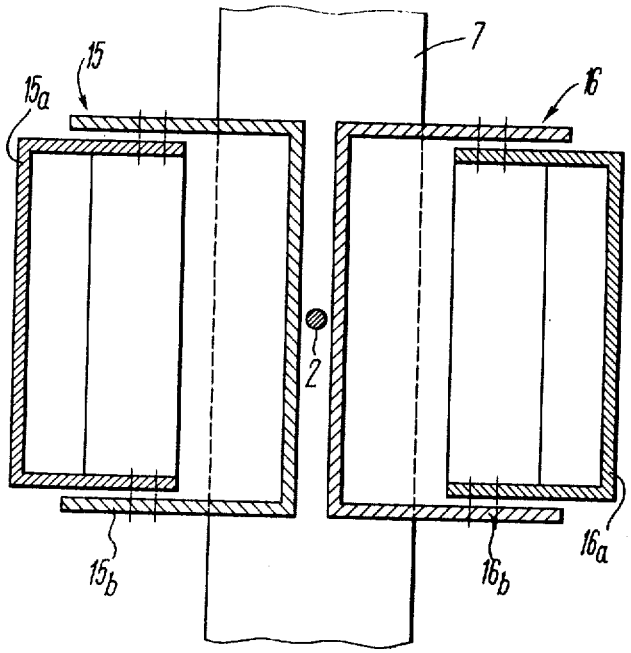
FIG. 5 illustrates the vibrating chutes in cross-section taken along line V—V in FIG. 2.

One of the vibrating chutes 15 (FIG. 5) and 16 or each of them (depending on whether one or both the moulding boards 13 and 14 are provided with a drive) consists of two parts **15*a* and 15*b* or 16*a* and 16*b* respectively, which parts are movably connected to each other for extending along the direction of movement of the respective moulding board. One part of each vibrating chute, for instance part 15*a*(16*a*) is connected through levers (not shown) to the drive 19 (FIG. 2**) of this moulding board for varying the passage area of the vibrating chute depending on the distance between the moulding board and the line of arrangement of the jacks, and, hence, on the distance between the moulding boards.

The feed hoppers 11 and 12 are provided with a swivel gates 34 (FIG. 2) and are connected with each other through locking means 35 (FIG. 1). The locking means 35 provide for a joint movement of the carriages 8 and 9 and preclude displacement thereof relative to each other in the direction of movement.

The locking means 35 are so constructed that when running into reinforcement bars of the wall 7 being erected they are automatically opened and closed without obstructing the movement of the apparatus.

To provide a tie between adjoining layers of concrete, the vibrating chutes 15 (FIG. 2) and 16 have projections **15*c* and 16*c* respectively, extending below the upper edges of the moulding boards 13 and 14**. These projections are adapted for producing grooves on the surface of the concrete layer being formed, which grooves are filled with a fresh concrete mix when casting the next of concrete layer, thereby providing a tie between adjoining concrete layers.

It is expedient that one or both the moulding boards 13 and 14 have a profile corresponding to the desired pattern, to thereby permit producing this pattern on the wall simultaneously with the erection thereof, thus providing economy in both materials and labour.

Casting a solid concrete wall with the aid of the proposed apparatus is done as follows. After the concrete placing of apparatus has been mounted on the construction site and the concrete mix has been prepared, the moulding boards 13 and 14 are positioned with the aid of the hand wheels 28 (FIG. 2) at a predetermined distance from the center line of the wall to be erected, which center line is the line of arrangement of the jacks. With the change of this distance the passage area of each vibrating chute 15 and 16 is also changed. The swivel gates 34 of the feed hoppers 11 and 12 are correspondingly opened. This done, the feed hoppers are charged with the concrete mix and the concrete placing apparatus is started.

The concrete mix from the feed hoppers 11 and 12 is fed into the vibrating chutes 15 and 16 which being oscillated by the vibrators 17 and 18 compact this concrete mix. The compacted concrete mix fills the space between the moulding boards 13 and 14 which being moved by the carriages 8 and 9 along the center line of the wall mould the concrete mix to form a layer **7*b* over the foundation or the previously formed layer 7*a*, the layer thickness being determined by the width of the moulding boards 13 and 14**, with the width of the layer depending on the distance between the moulding boards.

As the carriages 8 and 9 move in the direction shown by arrows in FIG. 1 the moulding boards 13 and 14 are oscillated by the vibrators 22 and 23 along the same direction, thereby decreasing the friction between these boards and the concrete mix. In this manner the concrete layer **7*b*** is formed along the whole length of the wall being cast. Since the concrete mix is compacted before being placed in wall, the concrete mix in the lower layer is not affected by the vibration, which facilitates setting of the previously placed concrete.

After a concrete layer is formed the jacks 1 being actuated by the hydraulic fluid moves upwards on the jack rods 2 to a height corresponding to the thickness of the next concrete layer raising to the same height the U-shaped frames 3 with the carriages 8 and 9.

In the case of casting walls with a heavy-weight concrete on the face side and light-weight concrete on the back side the hoppers 11 and 12 are charged each with a respective concrete mix. The same is done in the case of using concretes of different strength or colour.

Varying the cross section of the wall being cast is done by turning the moulding board 13 (14) about the axis of its hinge coupling with the rod 20 and fixing it in the desired position. To this end the stop pin 30 (FIG. 3) is withdrawn from the apertures of the lug 31 and of the strut 29, and the latter is disconnected from the rod 20 to let positioning the moulding board. After the moulding board is in the desired position the strut is fixed on the rod 20.

Figure 6:
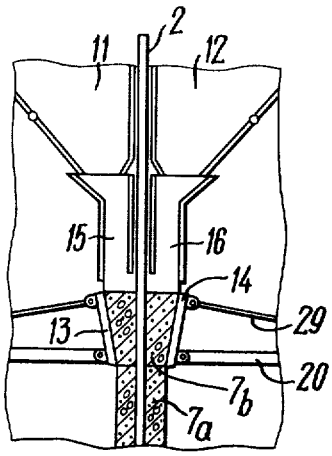
FIG. 6 schematically represents a process of forming a concrete layer of a trapezoidal profile (widening upwards) with the aid of the concrete placing apparatus according to the invention.

FIG. 6 illustrates the formation of the concrete layer *7b* of a trapezoidal profile widening upwards by changing the position of the moulding boards 13 and 14.

Figure 7:
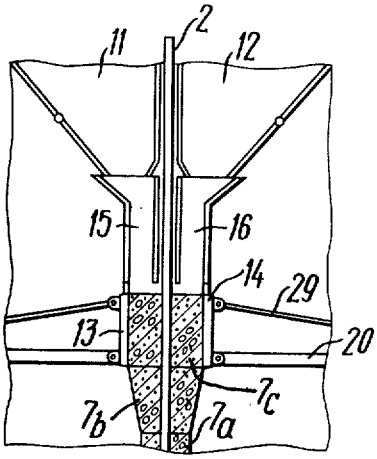
FIG. 7 schematically represents a process of forming a concrete layer of a rectangular profile with the aid of the concrete placing apparatus according to the invention.
Figure 8:
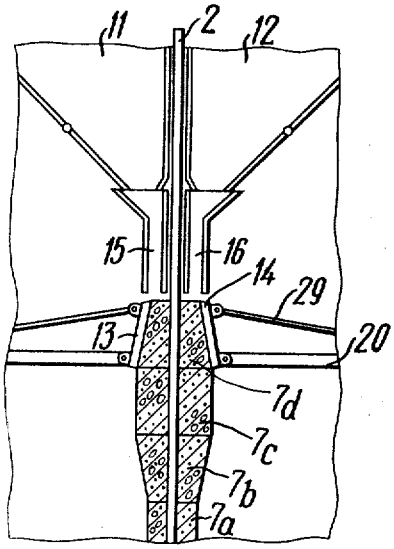
FIG. 8 schematically represents a process of forming a concrete layer of a trapezoidal profile (tapering upwards) with the aid of the concrete placing apparatus according to the invention.

If the next layer *7c* being formed over the previously formed layer *7b* is to be of a rectangular profile, the moulding boards are installed in their initial vertical position and then spaced to a distance being equal to the width of the upper end of the previously formed layer (FIG. 7). The formation of a concrete layer *7d* tapering upwards is effected in the same way as shown in FIG. 8.

Figure 9:
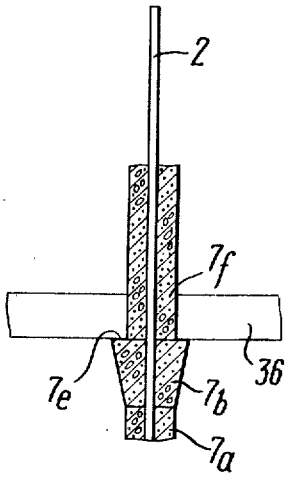
FIG. 9 schematically represents a process of placing floor slabs in position on the wall offsets formed with the aid of the concrete placing apparatus according to the invention.

The offsets *7e* on the wall being erected are formed as follows: first there is formed a layer *7b* of a trapezoidal shape widening upwards and then a layer *7f* of a rectangular shape (FIG. 9) whose width is smaller than the upper end of the previously formed layer *7b*. As a result the offsets are formed upon which the floor slabs 36, cross bars, relieving slabs or the like are installed after the wall is finished.

The proposed concrete placing apparatus permits the efficiency of the wall erection operation and the quality of walls to be improved.

In addition, unlike the prior art, the concrete moulding zone in the proposed apparatus is disposed at the same level as the scaffold board, which permits the operators both to do different construction jobs and to control the operation of the concrete placing apparatus.

While particular embodiments of the invention have been shown and described, various modifications thereof will be apparent to those skilled in the art and therefore is not intended that the invention be limited to the disclosed embodiments or to the details thereof and the departures may be made therefrom within the spirit and scope of the invention as defined in the claims.

What is claimed is:

1. A concrete placing apparatus for casting solid walls, comprising:

jacks arranged in line along a wall being cast;

U-shaped frames suspended on said jacks;

scaffolds connecting said frames and arranged on both sides and along the line of arrangement of said jacks;

driving carriages mounted on said scaffoids for movement therealong;

a feed hopper, a moulding board and a device for compacting concrete, all the three mounted on each said carriage:

at least one of said moulding boards comprising:

a drive for transversely moving said moulding board relative to the line of arrangement of said jacks so as to vary a distance between said moulding boards;

a rod connecting said moulding board to said drive;

said device for compacting concrete being made in the form of a vibrating chute disposed under said feed hopper and above said moulding board, and provided with a vibrating means for oscillating along the direction of movement of said moulding board;

one of said vibrating chutes which is disposed on the same carriage with said moulding board having a drive, consists of two parts attached to each other so as to be capable of extending in the direction of movement of said moulding board, one of these parts being connected with said drive of said moulding board for varying a passage area of said vibrating chute depending on the distance between said moulding board and the line of arrangement of said jacks.

2. A concrete placing apparatus as claimed in claim 1, wherein the moulding board is pivoted at its lower end to said rod and is provided with a strut pivoted to its upper end and privided with a locking device for being fixed on said rod at the desired distance from the lower end of said moulding board so as to enable varying an angular position thereof relative to a vertical line and fixing it in this position.

3. A concrete placing apparatus as claimed in claim 1, wherein at least one of said moulding boards is provided with a vibration means for imparting vibration movement to said board along the direction of movement of said carriages.

4. A concrete placing apparatus as claimed in claim 1, wherein at least one of said vibrating chutes has a projection extending below the upper edge of the moulding board and adapted to form grooves in the wall, which grooves are intended for providing a tie between adjoining concrete layers.

5. A concrete placing apparatus as claimed in claim 1, wherein at least one of said moulding boards has a profile corresponding to the desired pattern which is produced on the wall as the carriages are moved.

6. A concrete placing apparatus as claimed in claim 2, wherein at least one of said moulding boards has a vibrating means for imparting oscillatary motion to said moulding board along the direction of movement of said carriages.

7. A concrete placing apparatus as claimed in claim 2, wherein at least one of said vibrating chutes has a projection extending below the upper edge of said moulding board and adapted to form grooves intended for providing a tie between adjoining concrete layers.

8. A concrete placing apparatus as claimed in claim 2, wherein at least one of said moulding boards has a profile corresponding to the desired pattern which is produced on the wall face as the carriages are moved.

9. A concrete placing apparatus as claimed in claim 3, wherein at least one of said vibrating chutes has a projection extending below the upper edge of said moulding board and adapted to produce grooves in the wall for providing a tie between adjoining concrete layers.

10. A concrete placing apparatus as claimed in claim 3, wherein at least one of said moulding boards has a profile corresponding to the desired pattern which is produced on the wall as the carriages are moved.

11. A concrete placing apparatus as claimed in claim 4, wherein at least one of said moulding boards has a profile corresponding to the desired pattern which is produced on the wall as the carriages are moved.

* * * * *